US006058516A

United States Patent [19]

Purnell

[11] Patent Number: 6,058,516

[45] Date of Patent: May 9, 2000

[54] PROTECTIVE HEADGEAR FOR WRESTLERS

[76] Inventor: John W Purnell, 406 Lawrence Ave., West Lawn, Pa. 19600

[21] Appl. No.: 09/264,810

[22] Filed: Mar. 9, 1999

[51] Int. Cl.[7] ..... A63B 71/10

[52] U.S. Cl. ..... 2/425; 2/209

[58] Field of Search ..... 2/410, 411, 423, 2/425, 209

[56] References Cited

U.S. PATENT DOCUMENTS

| | | | |
|---|---|---|---|
| 3,596,288 | 8/1971 | Marchello | 2/425 |
| 4,710,985 | 12/1987 | Dubner et al. | 2/425 |
| 4,821,345 | 4/1989 | Marchello | 2/425 |
| 5,504,945 | 4/1996 | Purnell | 2/425 |
| 5,881,393 | 3/1999 | Marchello | 2/425 |

*Primary Examiner*—Michael A. Neas

*Attorney, Agent, or Firm*—Sherman & Shalloway

[57] ABSTRACT

The present invention relates to a wrestling ear guard comprising a pair of substantially identical mirror image, roughly inverted triangular shaped guards comprising a cup member formed of thin, relatively stiff, resilient sheet material having an inner concave surface and an outer convex surface, a first padded layer applied to the inner concave surface and comprising a roughly inverted triangular portion and outwardly and upwardly extending strap members integral with the triangular member at the upper top corners thereof, a second padded layer applied to the outer convex surface and comprising a roughly inverted triangular member corresponding in size to the inverted triangular portion of the first padded layer and being partially compressed over the outer surface thereof, the second layer being secured about its periphery to the first padded layer whereby the cup member is confined between the first padded layer and the second padded layer.

20 Claims, 3 Drawing Sheets

PROTECTIVE HEADGEAR FOR WRESTLERS

FIELD OF THE INVENTION

This invention relates to a protective headgear for use by wrestlers and other athletes who require protective covers for their ears during practice and contests. The headgear provides a multi-level degree of shock absorbency and protection for the ears in an easily adjustable and comfortable device.

BACKGROUND OF THE INVENTION

Amateur wrestlers are subjected to maneuvers and contact with opponents and the wrestling mat which can result in injuries to the outer ear surfaces and to the forehead. Such injuries can be the result of unintentional blows to the ear by opponents, abrasion by sliding contact with the mat, ie., mat burn, and unintentional head contact between opponents, ie., head butts. As a means of protecting against such injuries, ear guard devices are in wide-spread use and generally provide a reinforced cup shaped protector covering the ears.

Most ear guards are deficient in the level of protection they provide to both the wearer and opponents, either because of insufficient padding and thus reduced shock absorbency or because their construction results in a high profile which can catch on opponents', clothing or equipment. Other ear guards are complex in their construction and strap arrangement which renders them uncomfortable and difficult to adjust on the wearer for proper protection.

In his U.S. Pat. No. 5,504,945, the inventor herein provided an improved ear guard assembly of the type comprising an inner rigid shell with outer shock absorbing foam held in place by an overall encompassing molded flexible outer covering. A plurality of straps attaching directly to the rigid shell interconnect the ear guards to form the assembly. The ear guards of this patent provide a multi-level degree of protection and shock absorbency by means of an inner foam pad and an outer pad of partially compressed foam having a plurality of raised, uncompressed areas or plateaus separated by compressed lands or valleys. However, the ear guard of this patent remains somewhat complex in its construction and adjustability to obtain a proper fit on the user.

A simpler design of ear guard affording easier adjustment for fit is exemplified by Marchello, U.S. Pat. No. 3,596,288, and by Dubner, et al., U.S. Pat. No. 4,710,985. In this design, a wrestling helmet is formed from a pair of roughly inverted triangular shaped bulged ear guards each having an upper and a rear strap member integral with its upper corners. The strap members are adjustably interconnected for positioning the guard over the wearer's ears with the rear strap at the rear of the head and the upper strap extending over the top of the head. The lower corners of the guards are interconnected by a chin strap.

In Marchello, the guards and integral upper and rear straps are made from thin, relatively stiff but somewhat flexible sheet plastic which resiliently flexes but remains relatively stiff and self sustaining in the absence of pressure. Each guard has an outwardly bowed ear cup surrounded by a marginal flange. Within the cup is a pad comprising a resilient foam sheet confined between a pair of thin flexible plastic sheets which are bonded together along the peripheral edge of the pad. The pads are positioned within the ear cups so as to not overlap or cover the marginal flange which contacts the wearer's head. Thus, this ear guard provides padding only directly over the wearer's ear with no protection between the cup flange and the wearer's head or on the outer surface of the guard.

In the case of Dubner, et al., a similar construction provides a foam cushion directly over the ear, a non-deformable insert and an intermediate foam layer all located within the cup portion of an outer non-stretchable vinyl guard. As with Marchello, all of the padding is directly over the wearer's ear on the inner surface of the guard and provides only a single level of shock absorbency.

In the present invention, the multilevel degree of shock absorbency and protection of the inventor's prior U.S. Pat. No. 5,504,945 has been adapted to the Marchello/Dubner style of ear guard to provide a safer and more comfortable apparatus for wrestlers with a greater degree of protection for both the wearer and the opponent.

SUMMARY OF THE INVENTION

The present invention is an improvement over the prior art and provides an ear guard construction which results in better protection to both the wearer and his opponent and which provides a multi-level degree of protection and shock absorbency. In addition, the invention provides a protective ear guard assembly which is easier to adjust for optimum comfort and protection.

The present invention provides a wrestling ear guard comprising a pair of substantially identical mirror image, roughly inverted triangular shaped guards comprising a cup member formed of thin, relatively stiff, resilient sheet material having an inner concave surface and an outer convex surface, a first padded layer applied to the inner concave surface and comprising a roughly inverted triangular portion and outwardly and upwardly extending strap members contiguous with the triangular member at the upper top corners thereof, a second padded layer applied to the outer convex surface and comprising a roughly inverted triangular member corresponding in size to the inverted triangular portion of the first padded layer and being partially compressed over the outer surface thereof, the second layer being secured about its periphery to the first padded layer whereby the cup member is confined between the first padded layer and the second padded layer.

The present invention further provides a wrestling head gear comprising substantially identical, mirror image left and right halves, each half comprising an inverted, roughly triangular shaped ear guard and first and second strap members whereby the left and right halves are adjustably connected and wherein the ear guard comprises;

a) a cup member formed of thin, relatively stiff, resilient sheet material having an inner concave surface and an outer convex surface, the cup member being of a size to receive the auricle of the ear;

b) a first padded layer applied over the inner concave surface of the cup member and comprising a foam layer having a flexible outer covering thereover;

c) a second padded layer applied over the outer concave surface of the cup member and comprising a foam layer having a flexible outer covering thereover and being partially compressed over the outer surface thereof; whereby the second padded layer is secured to the first padded layer confining the cup member therebetween.

Thus, it is an object of this invention to provide an improved ear guard.

It is a further object to provide an improved ear guard having a multi-level degree of shock absorbency and ease of adjustment.

Further objects and advantages will become evident from the following drawings and descriptions.

DETAILED DESCRIPTION OF THE INVENTION

Figure 1:
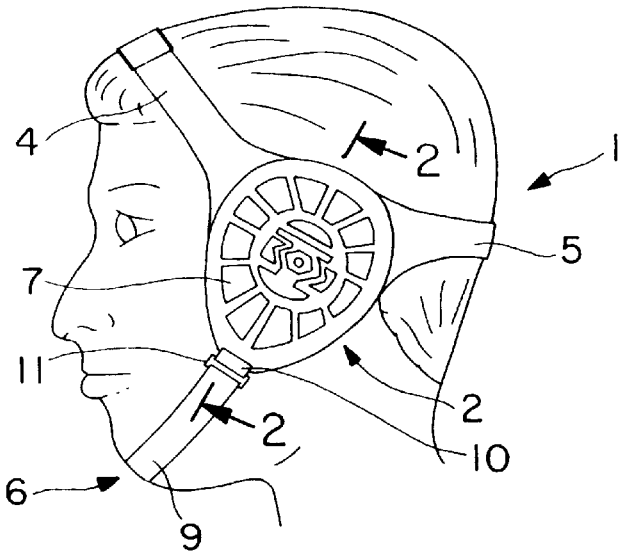
FIG. 1 is an oblique view of the protective ear guard assembly according to the present invention shown in place on the wearer's head.

FIG. 1 illustrates the protective ear guard assembly 1 of the present invention as worn on the head of a wrestler. The assembly comprises left and right ear halves 2 and 3 joined together in wearable form by straps 4 and 5. A chin strap is provided to hold the assembly in place on the wearer's head and may include a chin cup (not shown).

Figure 3:
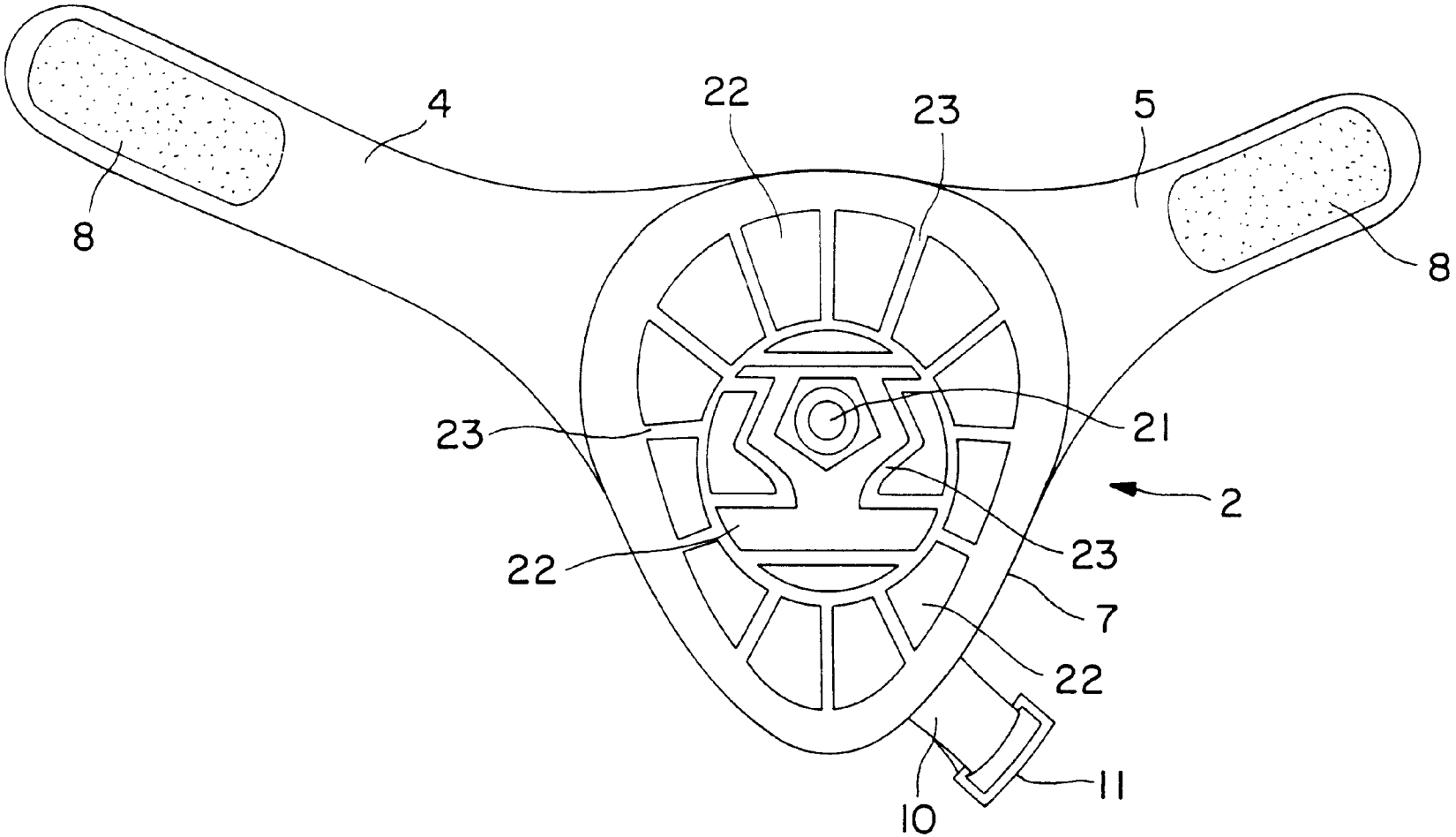
FIG. 3 is a plan view of the left half of the ear guard of the present invention.
Figure 4:
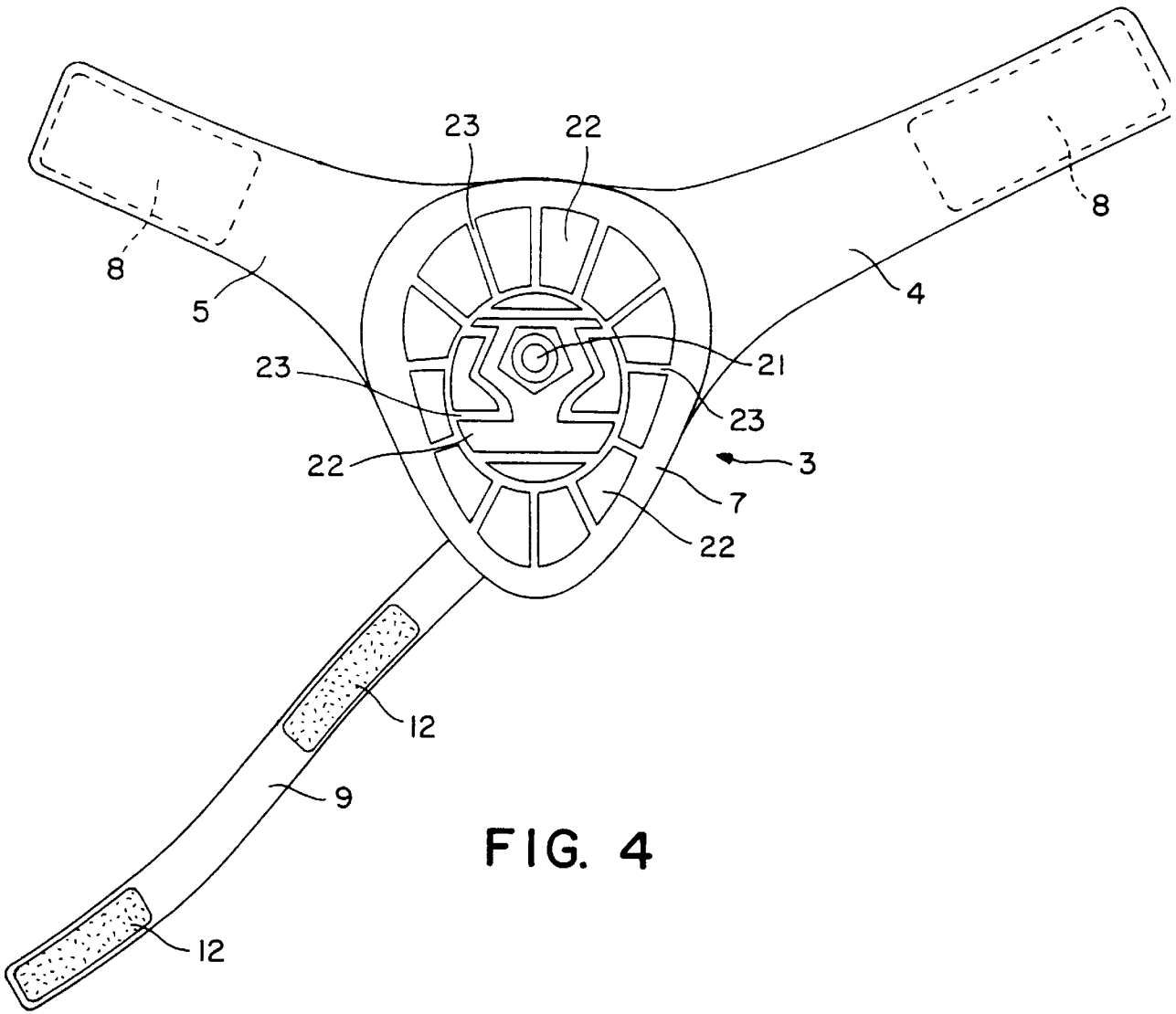
FIG. 4. is a plan view of the right half of the ear guard of the present invention.

As shown in FIG. 1, and more particularly in FIGS. 3 and 4, the left and right halves 2 and 3 of the ear guard assembly 1 are substantially mirror images and each comprises an ear cover 7 having an inverted roughly triangular shape. Straps 4 and 5 extend from the two upper corners of ear cover 7 with strap 4 extending upward so as to cross over the head when worn and strap 5 extending rearward around the back of the head as shown in FIG. 1. Straps 4 and 5 of each half are provided with an adjustable fastening means 8 to permit the ear guard assembly to be adjusted to fit different users. Preferably the fastening means is a hook and loop material, such as VELCRO®, with one part of the hook and loop material secured to the outer surface of the straps 4 and 5 of one half of the assembly and the other part secured to the inner surface of the straps 4 and 5 of the other half of the assembly. Preferably, the hook portion is secured to the outer surface of the straps 4 and 5 of the left half 3 and the loop portion is secured to the inner surface of straps 4 and 5 of the right half 2. Alternative fasteners such as snaps, multi-use adhesive strips, and the like may also be used. Chin strap 6 extends between the lower corners of ear covers 7 to traverse the wearer's chin. Although chin strap 6 may be a structure similar to straps 4 and 5, chin strap 6 is preferably a woven elastic strap and comprises a first long portion 9 secured to the lower corner of one ear cover 7 and a short loop 10 secured to the lower corner of the other ear cover 7. Loop 10 holds a "D" ring 11 or similar article and long portion 9 is of sufficient length to traverse the wearer's chin, pass through ring 11 and double back on itself to be secured by releasable, adjustable fastening means 12 such as VELCRO®, snaps, or the like.

Figure 2:
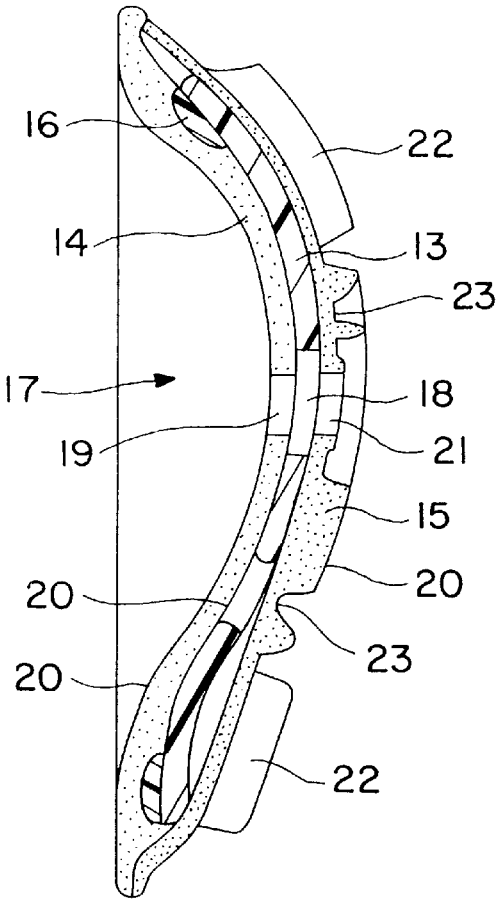
FIG. 2. is a cross section of the ear guard taken along line 2—2 of FIG. 1.

FIG. 2 illustrates a longitudinal cross section through ear cover 7 of the left half of ear guard 2 of FIG. 1. Right ear guard 3 is substantially identical. Ear guards 7 are constructed from four parts; an inner semi-rigid cup 13, an inner foam pad 14, an outer foam pad 15 and a neoprene ring 16.

Cup 13 is molded from a plastic material and has a concave inner surface and a convex outer surface. Cup 13 is sized so as to comfortably receive the auricle or outer ear within the cavity formed by the concave surface. Substantially centrally located in the cup 13 is at least one aperture 18 which serves to permit the equalization of air pressure over and within the user's ear when the assembly 1 is worn. Although illustrated with only one such aperture 18, ear covers 7 may be constructed with more than one aperture 18 without departing from the spirit of this invention. Around the outer periphery of the inner surface of cup 13 is positioned a ring 16 of neoprene rubber or similar material. Ring 16 provides a protective cushion around the edge of cup 13 which fits against the wearer's head around the ear with the added function of creating a stand-off around the perimeter of cup 13 to keep the cup 13 off of the wearer's ear.

As noted previously, the material from which cup 13 is molded is preferably a plastic having sufficient rigidity at a minimum thickness to maintain its shape under stress but with a degree of resiliency which allows cup 13 to flex to a certain degree when struck. In this manner, cup 13 is able to absorb forces and shocks which may be applied to ear covers 7 and which are greater than those absorbed by inner and outer foam pads 14 and 15. Examples of suitable plastic materials from which cup 13 may be molded include polyethylene, polystyrene, polyurethane, and the like.

In the preferred embodiment of the invention, inner foam pad 14 comprises an inverted triangular portion of a size to extend beyond the edge of cup 13 when molded to the concave surface of cup 13. Straps 4 and 5 are a contiguous part of inner pad 14. The material of inner foam pad 14 is preferably EVA foam of a first density, for example EVA P20 having a density of about 45 $Kg/M^3$, which is cut to shape and may be partially compressed over its entire surface, although pad 14 may also be provided in the uncompressed state as well as being formed from other foams having open or closed cells. An opening 19 is provided substantially in the center of the inverted triangular portion to be in line with aperture 18 of cup 13. Inner pad 14 is encased in a thin, lightweight woven or non-woven fabric cover 20, such as tricot, which provides a smooth, low friction surface for added strength and comfort. The fabric cover 20 is bonded to the foam and, preferably, has an edge bead sewn around the perimeter.

By forming straps 4 and 5 as a contiguous part of the inner pad 14, they have sufficient flexibility to wrap about the head and are soft so as not to present any sharp edges or points which may cause injury. The outer fabric cover adds strength and provides a smooth surface for both comfort and low friction.

Outer foam pad 15 has a dimension substantially equal to that of the inverted triangular portion of inner pad 14 and includes a central opening 21 corresponding to opening 19 of inner pad 14. Alternatively, straps 4 and 5 may be an integral part of outer pad 15 while inner pad 14 is limited to the inverted triangular portion.

Like inner foam pad 14, outer pad 15 is preferably formed from EVA foam but, preferably, is of a different density. However, whereas inner pad 14 is provided in a single thickness, outer pad 15 is molded to include a plurality of raised areas 22 surrounded by compressed areas 23. Preferably, the raised areas 22 constitute greater than 50% of the area of outer pad 15 with the compressed areas being less than 50% of the area. Most preferably, the relationship is about 75% raised and about 25% compressed. The compressed areas 22 are preferably about one half the thickness of the raised areas 23 of foam which preferably has an overall thickness of about 6 mm to about 8 mm with each raised area 22 being substantially surrounded by compressed area 23. The compressed areas 23 preferably have a thickness of about 3 mm to about 5 mm. The structure of the outer foam pad 15 may be produced in any way suitable for molding foam. For example, a block of uncompressed foam may be molded between two dies to compress the foam and produce a pattern corresponding to the compressed areas 23 of pad 15. Alternatively, the foam precursors may be introduced into a closed mold having the shape of the pad to be produced whereupon expansion of the foam fills the mold and cures to form pad 15. As with inner foam pad 14, outer pad 15 is also encased in a thin, lightweight woven or non-woven fabric, such as a tricot 20 which is applied during or after molding providing strength to the foam and a low friction outer surface. The low friction afforded by the fabric cover is advantageous when the ear guard comes in contact with a wrestling mat or other surface in that the ear guard is more likely to slide across the mat surface rather than catching.

The foam of inner pad 14 and outer pad 15 may be of the same density or different densities. Preferably, outer pad 15 is formed from a lower density foam, for example EVA P30 having a density of about 35 $Kg/M^3$, to provide a greater initial shock absorbance. Neoprene ring 16 has a thickness of about 2–5 mm and a preferred density of about 0.2±0.02 $g/cm^3$ and causes the area of inner pad 14 adjacent the edge of cup 13 to bulge outward as an added cushion against the wearer's head. It is noted that the densities of the inner and outer foam pads and the neoprene ring are examples of preferred materials for optimum protection. Other foam materials of different densities may be used and still be within the scope of the present invention.

In assembly, neoprene ring 16 is adhered around the periphery of the concave surface of cup 13 and inner pad 14 is applied and bonded to the concave surface of cup 13 so as to cover both cup 13 and ring 16 with a perimeter of pad 14 extending beyond the edge of cup 13. Outer pad 15, after molding, is placed over the convex surface of cup 13 with the partially compressed surface of pad 15 outermost. Like inner pad 14, the perimeter of outer pad 15 extends beyond the edge of cup 13 and outer pad 15 and inner pad 14 are secured to each other about their peripheries, preferably by stitching. Outer pad 15 is also preferably adhesively bonded to cup 13. The portions 9 and 10 of chin strap 6 are secured to ear covers 2 and 3 also by stitching.

Applicant has found that the above-described construction for ear guards provides a greater degree of protection to users and opponents and greater absorbance of shock than is achieved with the prior art constructions of Marchello and Dubner. The ability to use different densities of foam allows the ear guards to be made with a shallower profile while maintaining or increasing the level of protection over prior art ear guards of this style. The shallower profile compliments the low friction of the fabric cover to allow the wearer's head to slide easily across a wrestling mat. The structure of Applicant's outer foam pad 15 wherein the raised areas 22 of the foam are exposed to direct contact before the rest of the ear guard results in a two level rate of absorption of shock. When in use, the first contact with the ear guards is on the uncompressed foam which compresses to absorb any force applied thereto without transmitting that force to the user. As these areas are compressed to the level of the compressed areas 23, the rest of the outer foam pad begins to absorb the forces being applied thereto. In addition, some of the excess force being applied to the now compressed raised areas 22 is directed laterally into the body of foam pad 15 by the shape of cup 13 to be finally transferred to the neoprene ring 16 which surrounds the wearer's ear and to inner foam pad 14. Furthermore, the exposure of the softer and more compliant foam as the first surface of contact affords greater protection to the wearer's opponents than a less yielding material such as the continuous vinyl cover of prior ear guards.

In the event a sudden shock is applied to the outer surface of ear covers 7, not only is a portion of that shock absorbed and redirected by the structure of the foam pads 14 and 15 and the cup 13, but, where the force of the shock is sufficient, cup 13 flexes and thus absorbs and diverts the shock radially outward. In this manner less of the shock and associated pressure is transmitted to the user's ears.

The structure of the ear guard of the present invention and its method of manufacture has added benefits in that it permits the ear guard to be manufactured in a plurality of colors to match those of national, regional and/or local teams. Thus, the covering 20 of inner pad 14 may be a different color than the covering 20 of outer pad 15, thereby permitting the ear guards to be manufactured to correspond to team or school colors. Previous ear guards of this style were limited to a single visible color. In addition, the molding of outer pad 15 may be such as to correspond to a particular logo or mascot figure. In this regard, it is noted that the drawing figures illustrate a logo used by Brute Co., of Pennsylvania which is a distributor of wrestling equipment and which logo is used here by permission. In this configuration the raised areas 22 constituting the logo and the substantially trapezoidal shaped raised areas 22 surrounding the logo comprise greater than 50% of the surface area of the outer pad 15 and provide the area of first contact.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed is:

1. A wrestling ear guard comprising a pair of substantially identical mirror image, roughly inverted triangular shaped guards comprising a cup member formed of thin, relatively stiff, resilient sheet material having an inner concave surface and an outer convex surface, a first padded layer applied to the inner concave surface and comprising a roughly inverted triangular portion and outwardly and upwardly extending strap members integral with the triangular portion at the upper top corners thereof, a second padded layer applied to the outer convex surface and comprising a roughly inverted triangular member corresponding in size to the inverted triangular portion of the first padded layer and being partially compressed over the outer surface thereof, the second layer being secured about its periphery to the first padded layer whereby the cup member is confined between the first padded layer and the second padded layer, and a roughly triangular ring of compressible resilient material positioned adjacent to the inner edge surface of the cup member and confined between the cup member and the first padded layer.

2. The ear guard of claim 1 wherein the first padded layer is made from foam material of a first density.

3. The ear guard of claim 2 wherein the second padded layer is made from foam material of a second density.

4. The ear guard of claim 1 further comprising cooperating fastening means on said strap members to connect the pair of guards thereby forming an upper strap and a rear strap for positioning the guards on opposite sides of the wearer's head for receiving the wearer's ears within the cups.

5. The ear guard of claim 4 further comprising a releasable chin strap connecting the lower corners of the guards.

6. The ear guard of claim 5 wherein the upper strap, rear strap and chin strap are adjustable.

7. The ear guard of claim 1 wherein the second padded layer has a plurality of raised, uncompressed areas over the outer surface.

8. The ear guard of claim 7 wherein the uncompressed areas form a specific pattern or design.

9. The ear guard of claim 7 wherein the first and second padded layers comprise EVA foam with a flexible outer covering adhered thereto.

10. The ear guard of claim 9 wherein the flexible outer covering is a woven fabric.

11. The ear guard of claim 9 wherein the flexible outer covering is a non-woven fabric.

12. The ear guard of claim 1 wherein the ring is made from a material having a density different from that of first or second padded layer.

13. The ear guard of claim 12 wherein the ring is made from neoprene.

14. A wrestling head gear comprising substantially identical, mirror image left and right halves, each half comprising an inverted, roughly triangular shaped ear guard and first and second strap members whereby the left and right halves are adjustably connected and wherein the ear guard comprises;

a) a cup member formed of thin, relatively stiff, resilient sheet material having an inner concave surface and an outer convex surface, the cup member being of a size to receive the auricle of the ear;

b) a first padded layer applied over the inner concave surface of the cup member and comprising a foam layer having a flexible outer covering thereover;

c) a second padded layer applied over the outer concave surface of the cup member and comprising a foam layer having a flexible outer covering thereover and being partially compressed over the outer surface thereof; and d) a ring of resilient material positioned adjacent to the edge of the cup member and between the cup member and the first padded layer;

whereby the second padded layer is secured to the first padded layer confining the cup member therebetween.

15. The head gear of claim 14 whereby the first and second strap members are contiguous with the first padded layer.

16. The head gear of claim 14 whereby the first and second strap members are contiguous with the second padded layer.

17. The head gear of claim 14 wherein the flexible outer covering of first and second padded layers is a flexible woven fabric.

18. The head gear of claim 14 wherein the partially compressed outer surface of the second padded layer comprises a plurality of raised areas comprising uncompressed foam separated by areas of compressed foam.

19. The head gear of claim 18 wherein the raised areas of the partially compressed outer surface of the second padded layer form a specific pattern or design.

20. The headgear of claim 14 wherein the flexible outer covering of first and second padded layers is a flexible nonwoven fabric.

* * * * *